US005642719A

United States Patent [19]

Brown

[11] Patent Number: 5,642,719

[45] Date of Patent: Jul. 1, 1997

[54] AUTOMOTIVE FUEL DELIVERY MODULE WITH FUEL LEVEL ACTUATED RESERVOIR

[75] Inventor: Bradley A. Brown, Leonard, Mich.

[73] Assignee: Ford Motor Company, Dearborn, Mich.

[21] Appl. No.: 526,724

[22] Filed: Sep. 11, 1995

[51] Int. Cl.[6] ..... F02M 37/04; E03B 11/00

[52] U.S. Cl. ..... 123/509; 137/572

[58] Field of Search ..... 123/509, 514, 123/497; 137/574, 113, 101.27, 571, 572, 576

[56] References Cited

U.S. PATENT DOCUMENTS

| | | | |
|---|---|---|---|
| 1,854,317 | 5/1932 | Teesdale et al. . | |
| 3,785,750 | 1/1974 | Bryant . | |
| 4,279,232 | 7/1981 | Schuster et al. . | |
| 4,309,155 | 1/1982 | Heinz et al. . | |
| 4,546,750 | 10/1985 | Brunell et al. . | |
| 4,672,937 | 6/1987 | Fales et al. | 123/509 |
| 4,694,857 | 9/1987 | Harris . | |
| 4,747,388 | 5/1988 | Tuckey . | |
| 4,807,582 | 2/1989 | Tuckey . | |
| 4,831,990 | 5/1989 | Tuckey . | |
| 4,869,225 | 9/1989 | Nagata et al. . | |
| 4,893,647 | 1/1990 | Tuckey . | |
| 4,928,657 | 5/1990 | Asselin . | |
| 4,971,017 | 11/1990 | Beakley et al. . | |
| 4,974,570 | 12/1990 | Szwargulski et al. . | |
| 5,044,344 | 9/1991 | Tuckey et al. . | |
| 5,070,849 | 12/1991 | Rich et al. . | |
| 5,195,494 | 3/1993 | Tuckey . | |
| 5,197,445 | 3/1993 | Casari . | |
| 5,218,942 | 6/1993 | Coha et al. . | |
| 5,237,977 | 8/1993 | Tuckey . | |
| 5,363,827 | 11/1994 | Siekmann | 123/509 |
| 5,398,659 | 3/1995 | Zimmerman et al. | 123/514 |
| 5,415,146 | 5/1995 | Tuckey . | |
| 5,456,235 | 10/1995 | Porter | 123/509 |

FOREIGN PATENT DOCUMENTS

| | | |
|---|---|---|
| 53-36719 | 5/1978 | Japan . |
| 55-87854 | 7/1980 | Japan . |

*Primary Examiner*—Thomas N. Moulis
*Attorney, Agent, or Firm*—David B. Kelley

[57] ABSTRACT

A fuel delivery system for delivering fuel from a fuel tank to an internal combustion engine has a fuel pump with a pump inlet and a pump outlet, a fuel reservoir with a reservoir outlet, and a chamber connecting the pump inlet with the reservoir outlet. A reservoir supply valve between the reservoir outlet and the chamber is moved between an open position in which fuel flows from the reservoir to the chamber and a closed position in which fuel is prevented from flowing from the reservoir to the chamber, by a fuel level sender having a float arm which depresses or releases a plunger extending from the reservoir supply valve. A float attached to the float arm rises and falls with changes in fuel level within the fuel tank so as to contact the plunger and thus move the valve between the open and closed position when the tank fuel level is below and above, respectively, a predetermined level.

14 Claims, 3 Drawing Sheets

AUTOMOTIVE FUEL DELIVERY MODULE WITH FUEL LEVEL ACTUATED RESERVOIR

FIELD OF THE INVENTION

The present invention relates to automotive fuel delivery systems.

BACKGROUND OF THE INVENTION

It is desirable to have a constant source of fuel for a fuel pump within a fuel delivery system. To this end, fuel system designers have mounted a fuel reservoir within the tank which either remains filled as the fuel level within the tank falls, or, as is more commonly done, it continuously replenished with fuel from the tank, either by routing a portion of pressurized fuel to a jet pump to entrain fuel from the tank to the reservoir, as disclosed in U.S. Pat. No. 869,225 (Nagata et al.), or by routing return fuel to the reservoir as in U.S. Pat. No. 4,694,857 (Harris), or a combination of these, as disclosed in U.S. Pat. No. 5,070,849 (Rich et al.) and U.S. Pat. No. 5,218,942 (Coha et al.). Fuel pumps in the aforementioned patents draw fuel directly from the reservoir during operation. In many designs, the fuel pump is located within the reservoir, thus contributing to an increase in fuel temperature of the fuel drawn into the fuel pump due to heat generated from operation of the fuel pump. In addition, fuel returned from the engine to the reservoir is typically at a substantially higher temperature than fuel within the fuel tank. Higher temperature fuel typically contains a higher fuel vapor content, all other factors being equal, which is undesirable from an engine performance standpoint.

One solution to the problem is to pressurize the fuel in the reservoir so as to reduce vaporization of fuel therein, as disclosed in U.S. Pat. No. 5,431,143 (Brown), assigned to the assignee of the present invention and incorporated by reference herein. An additional advantage of that invention is drawing fuel directly from the fuel tank, which is typically cooler than fuel in the reservoir, as described above.

A problem has been noted, however, with the foregoing invention. When the fuel system is operating in a high temperature environment, for example in desert or arid regions when fuel tank temperatures can reach 140° F. or higher. It has been found that the pressure differential between the fuel reservoir and the conduit leading to the fuel pump can generate noise due to expansion of fuel when the valve therebetween opens. Since the conduit is essentially in a vacuum, the pressure differential across the valve is higher than the pressure within the reservoir.

There is thus a need for a fuel delivery system in which flow of fuel from the reservoir to the fuel pump is triggered in response to fuel level within the tank, but which is not dependent upon fuel pressure within the reservoir.

SUMMARY OF THE INVENTION

The present invention addresses the problems of the related art by providing a fuel delivery system for delivering fuel from a fuel tank to a fuel metering system of an internal combustion engine in which the flow of fuel from a reservoir to a fuel pump is triggered solely on fuel level within the fuel tank. The system comprises a fuel pump having a pump inlet and a pump outlet in fluid communication with the fuel metering system. The system also has a fuel reservoir in fluid communication with a fuel return line for continuously filling the reservoir with fuel. A chamber connects the pump inlet with a reservoir outlet, and a reservoir supply valve between the reservoir outlet and the chamber regulates fuel flow from the reservoir to the chamber in response to fuel level within the fuel tank. During normal operation, that is, when fuel in the tank is not below a predetermined level, the fuel pump draws fuel through a flapper valve in the chamber which allows fuel to flow directly from the fuel tank into the pump and thereby be pumped to the fuel metering system. However, when fuel in the fuel tank falls below a predetermined level, the reservoir supply valve opens allowing fuel from the reservoir to flow through the reservoir outlet into the chamber, and to the pump inlet for delivery to the fuel metering system. The flapper valve is preferably a one-way valve which prevents fuel flow from the chamber to the fuel tank.

Preferably, a fuel level sender is operatively associated with the reservoir supply valve to move the reservoir supply valve to an open position when fuel within the fuel tank is below the predetermined level so that fuel from the reservoir flows into the chamber to the pump inlet. When fuel within the fuel tank is above the predetermined level, the fuel level sender is operable to move the reservoir supply valve to a closed position thereby preventing fuel from flowing from the reservoir to the chamber so that it collects within the reservoir and so that the fuel pump will draw fuel directly from the fuel tank.

The fuel level sender preferably has a float arm with a first end attached to the reservoir fox pivotable movement with respect thereto, and a second end having a float attached thereto which rises and falls with changes in fuel level within the fuel tank. Rotation of the float arm about the first end results in actuation of the reservoir supply valve between the open and closed position as the float is moved below and above the predetermined level, respectively. Actuation of the reservoir supply valve between the open and closed positions is accomplished by a plunger extending from the reservoir supply valve which is depressed by the float arm when the fuel level of fuel within the fuel tank falls below the predetermined level. The weight of the float arm on the plunger overcomes the force of a spring biasing the reservoir supply valve to the closed position so that the valve can move to the open position to allow fuel flow form the reservoir to the chamber. When the float is above the predetermined level, the float arm rotates to a position in which it does not depress the plunger so that the spring biases the reservoir supply valve to the closed position to prevent fuel flow from the reservoir to the chamber.

An advantage of the present invention is a fuel delivery system in which fuel flow from a reservoir within the fuel tank is triggered solely by fuel level within the fuel tank.

Another advantage is a fuel delivery system which is inexpensive to manufacture and easy to assemble.

Yet another advantage is a fuel delivery system which draws fuel directly from the fuel tank during times when fuel level within the fuel tank is above a predetermined level.

A feature of the present invention is a fuel reservoir having an outlet leading to a chamber in communication with a fuel pump inlet, the outlet selectively opened and closed in response to the fuel level within the fuel tank.

Another feature is a reservoir supply valve for opening and closing the reservoir outlet actuated by movement of a fuel sender float arm below and above a predetermined level within the fuel tank.

BRIEF DESCRIPTION OF THE DRAWINGS

These and other objects, advantages, and features of the present invention will be apparent to those skilled in the automotive fuel system arts upon reading the following description with reference to the accompanying drawings, in which.

DETAILED DESCRIPTION OF THE PREFERRED EMBODIMENTS

Figure 1:
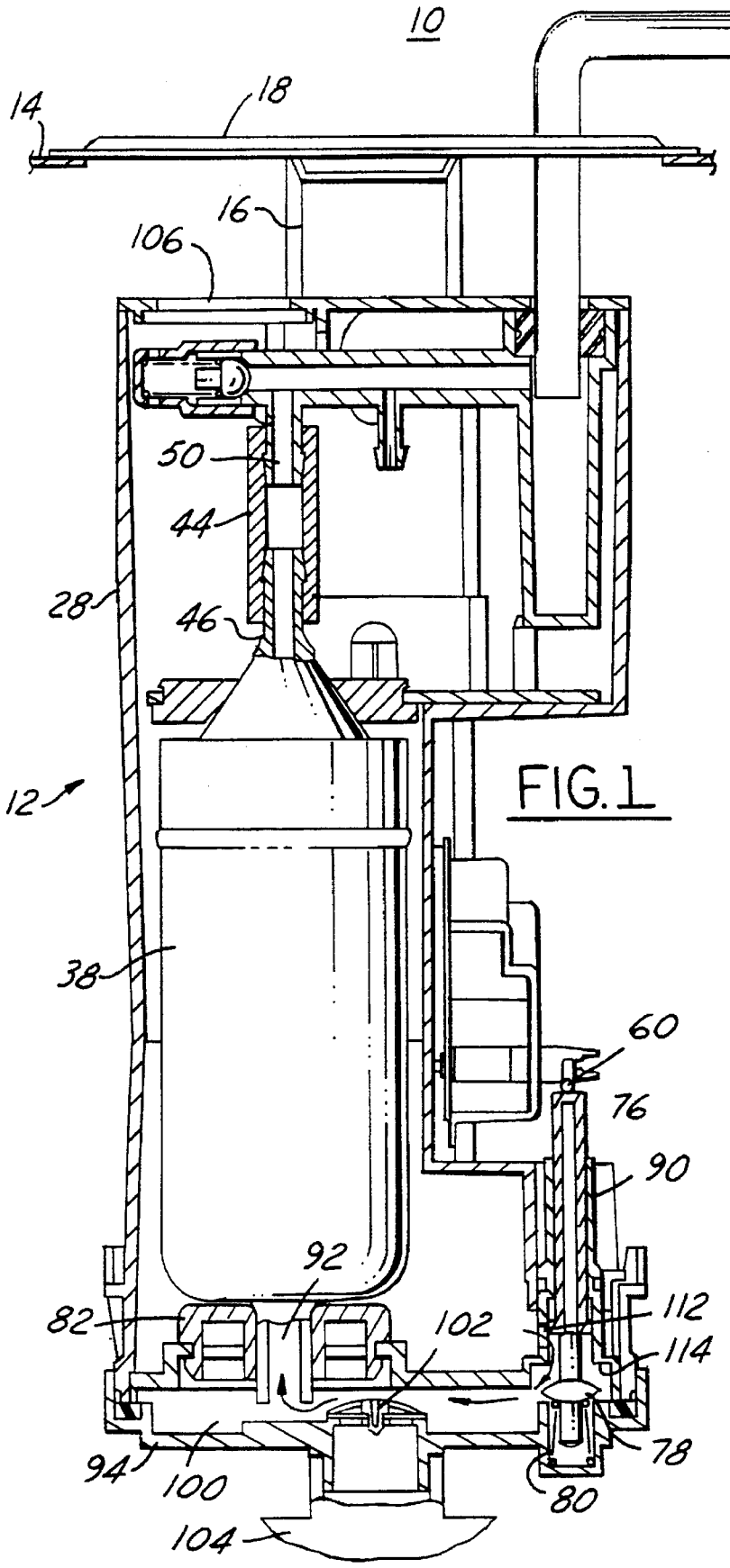
FIG. 1 is a schematic view of a fuel delivery system according to the present invention showing a reservoir supply valve in an open position.

Referring now to the drawings and in particular to FIG. 1 thereof, a fuel delivery system 10 has a fuel module 12 mounted within a fuel tank 14 via a bracket 16 attached to a flange 18. As better seen in FIG. 3, the brackets 16 attach to an upper module plate 20 with screws 22 which attach to side brackets 24 extending from the top plate 20. The side brackets 24 likewise are attached to a mid plate 26, all of which fit onto a reservoir 28. The top plate 20 has a pair of holes 30, 32 which receive ends of a fuel supply line 34 and a fuel return line 36, respectively. A fuel pump 38 is mounted within the reservoir 28 and has a top grommet 40 which fits within an orifice 42 of the mid plate 26. A rubber hose 44 fits over a fuel pump outlet 46 at a top surface 48 of the fuel pump 38. The rubber hose 44 attaches to a nipple 50 extending downwardly from a conduit 52 which leads to an adapter 54 which is coupled with the fuel line 34.

The reservoir 28 has a fuel sender, generally indicated at 56, attached to a side 58 thereof. The fuel sender 56 operates in conventional fashion, as will be apparent to those skilled in the art. Briefly stated, a first end 60 of a float arm 62 is rotatably mounted to the sender base 64, while the other end 66 has a float 68 fixed thereto for floatation with the fuel level 70 (FIG. 4) within the fuel tank 14. A contact 72 on end 60 travels over track 74 to vary the electrical potential therethrough in a known manner.

Figure 3:
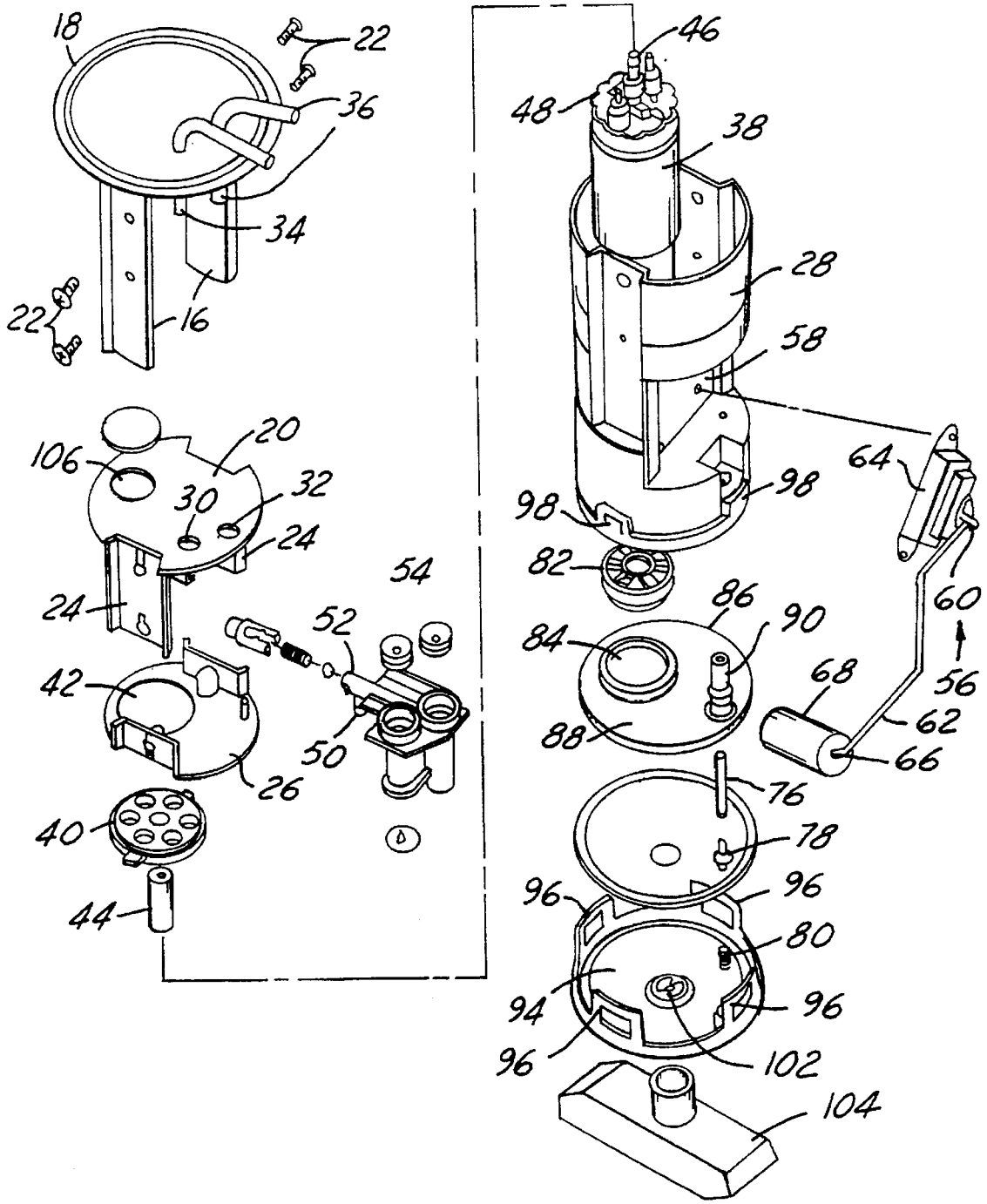
FIG. 3 is an exploded perspective view of a fuel delivery system according to the present invention.
Figure 5:
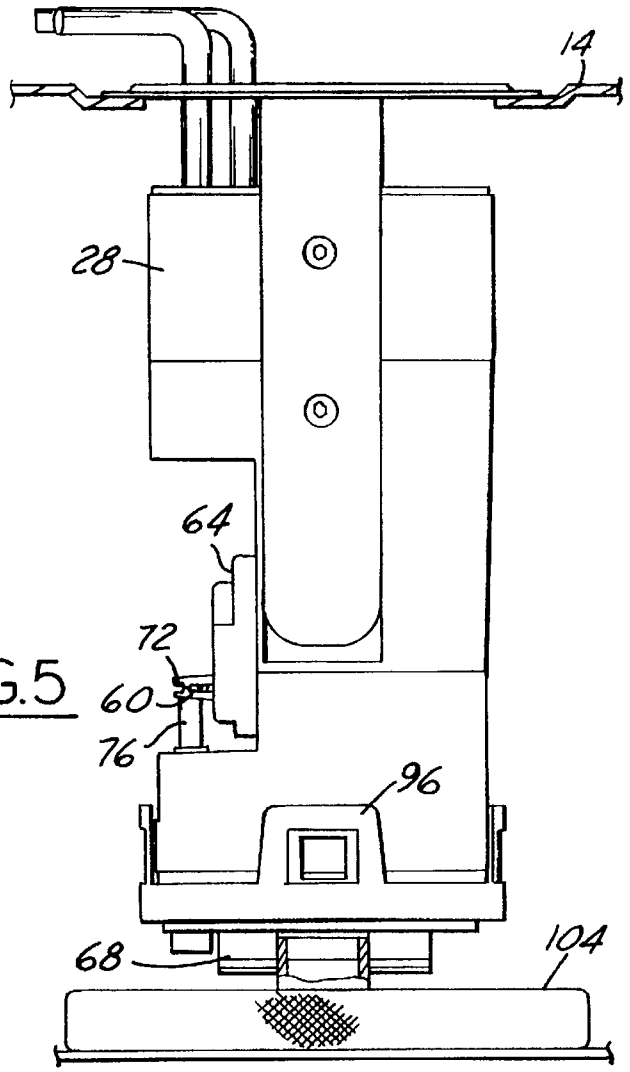
FIG. 5 is another perspective view of a fuel delivery system according to the present invention in a fuel tank.
Figure 4:
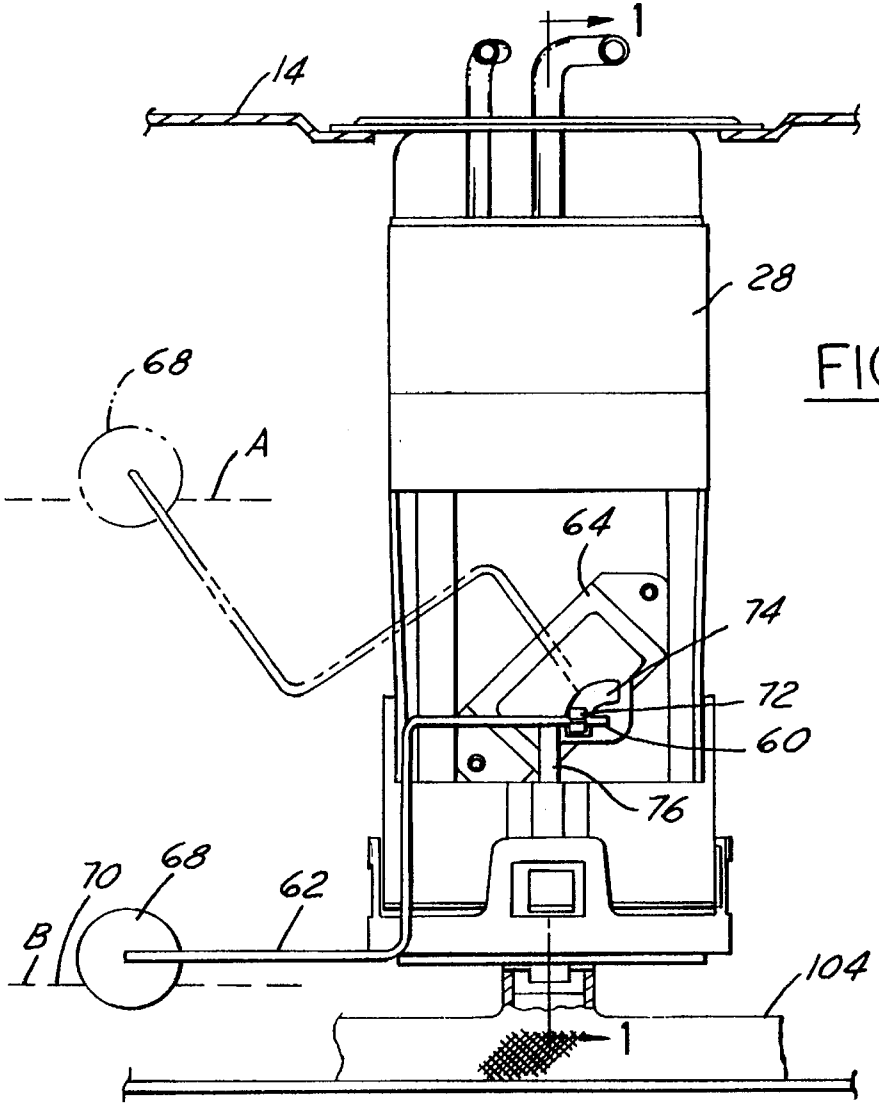
FIG. 4 is a side perspective view of a fuel delivery system according to the present invention as mounted within a fuel tank and showing a float and float arm of a fuel level sender above and below a predetermined fuel level.

In the present invention, as best seen in FIG. 4, a plunger 76 is mounted in close proximity to a lower end of the track 74 so that the end 60 of float arm 62 may depress the plunger 76 when the fuel level 70, and thus the float arm 62, is below a predetermined level. When depressed, the plunger 76 opens a reservoir supply valve 78 against the force of a biasing spring 80 (FIGS. 1 and 3).

Referring now to FIG. 3, a pump bottom grommet 82 fits within an orifice 84 in the reservoir bottom 86. Extending from an upper surface 88 of the reservoir bottom 86, is a sleeve 90 which guides the plunger 76 (FIG. 1). The grommet 82 fits around a pump inlet 92 (FIG. 1).

A reservoir bottom 94 has clips 96 circumferentially spaced therearound which snap into tabs 98 on the reservoir 28. The chamber partition 86 and the reservoir bottom 94 cooperate to form a chamber 100 (FIG. 1) through which fuel from the reservoir 28 passes when the reservoir supply valve 78 is in an open position, as shown in FIG. 1, while flowing to the fuel pump inlet 92. The reservoir bottom 94 has a one-way flapper valve therethrough which allows fuel to flow from the tank 14 into the chamber 100, but prevents fuel flow from the chamber 100 to the tank 14. Attached to the reservoir bottom 94 is a fuel filter sock 104 (FIGS. 1 and 3).

In operation, fuel pump 38 draws fuel from the tank 14 through the fuel filter sock 104, through flapper valve 102, and through the pump inlet 92 (FIG. 1). Pressurized fuel is then conveyed to a fuel rail of an internal combustion engine (not shown) by the fuel supply line 34, and unburned fuel is returned through the return line 36 to the reservoir 28 which is subsequently filled during normal vehicle operation so as to supply a ready source of fuel to the fuel pump 38 when the fuel within the tank 14 is low, or during cornering or grade parking. The reservoir 28 is not enclosed so that fuel overage spills into the tank 14 through an orifice 106 in the top plate 20.

Figure 6:
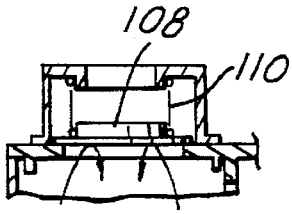
FIG. 6 is a schematic view of a relief valve on the reservoir shown in a closed position.
Figure 7:
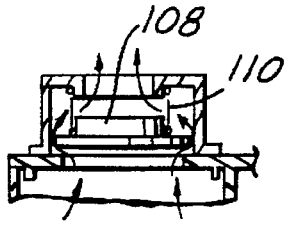
FIG. 7 is a schematic view similar to FIG. 6 but showing the relief valve in an open position.

In an alternate embodiment, the orifice 106 may have a pressure valve 108 attached thereto so that the reservoir 28 is fully enclosed. With such a design, fuel returning to the reservoir 28 through the return line 36 fills the reservoir 28 and pressure builds therein until the force of a spring 110 biasing the valve 108 to the closed position (FIG. 6) is overcome so that the valve 108 opens (FIG. 7) to allow fuel flow through the orifice 106 and into the tank 14. Pressure build-up within the reservoir 28 reduces vaporization of the hot return fuel so that a larger portion of the fuel within the reservoir is in a liquid state.

Figure 2:
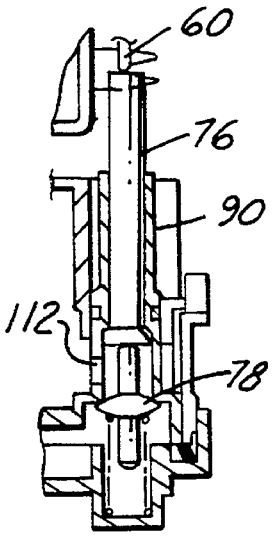
FIG. 2 is a partial schematic view of FIG. 1 showing the reservoir supply valve in the closed position.

When the fuel level in tank 14 is above a predetermined level A (FIG. 4), the float arm 62 does not depress the plunger 76 so that the force of the spring 80 in the reservoir supply valve 78 forces it to a shut position (FIG. 2). In the shut position, the reservoir supply valve blocks fuel flow from the reservoir 28 through a reservoir outlet 112 into the chamber 100. The fuel pump 38 thus draws fuel from the fuel tank 14, through the fuel filter sock 104, through the flapper valve 102 and into the pump inlet 92, as previously described.

When the fuel level in the fuel tank 14 falls below a predetermined level, for example, level B (FIG. 4), float 68 drops by gravity to that same level, thus rotating the float arm 62 to a position C which depresses the plunger 76 against the reservoir supply valve 78, which in turn presses against spring 80. The reservoir supply valve is thus pressed away from the valve seat 114, thus allowing fuel flow from the reservoir 28 through the reservoir outlet 112 and into the chamber 100 where it is drawn into the pump 38 through the pump inlet 92 (FIG. 1).

The predetermined level at which the fuel arm 62 depresses the plunger 76 to allow fuel flow from the reservoir to the chamber 100 will depend upon many factors, including the shape of the tank 14, the type of vehicle, and other considerations known to those skilled in the art and suggested by this disclosure. It will be apparent to those skilled in the art that a jet pump or other fuel entraining device is not required for operation of this invention. In addition, the fuel pump 38 need not necessarily be mounted within the reservoir 28, but in any case, it is designed to draw relatively cool fuel from the tank 14 during normal operation when the fuel level within the tank 14 is above a predetermined level.

I claim:

1. A fuel delivery system comprising:

(1) a fuel pump having a pump inlet and a pump outlet in fluid communication with a fuel metering system of an internal combustion engine;

(2) a fuel reservoir having a fuel source in fluid communication therewith and a reservoir outlet;

(3) a chamber connecting said pump inlet and said reservoir outlet;

(4) tank valve means in said chamber in fluid communication with a fuel tank for permitting fuel flow from said tank to said chamber;

(5) reservoir supply valve means between said reservoir outlet and said chamber for allowing fuel flow from said reservoir to said chamber when fuel in said fuel tank falls below a predetermined level, and for preventing fuel from flowing from said reservoir to said chamber when fuel in said fuel tank is above said predetermined level; and (6) a fuel level sender for actuating the supply valve means.

2. A fuel system according to claim 1 wherein said supply valve means comprises a spring-loaded valve obstructing said reservoir outlet when fuel in said fuel tank is above a predetermined level.

3. A fuel system according to claim 1 wherein said tank valve means comprises a one-way valve flapper valve which allows fuel flow from said tank to said said chamber while preventing fuel flow from chamber to said tank.

4. A fuel system according to claim 1 wherein said fuel pump is mounted in said fuel reservoir.

5. A fuel system according to claim 1 wherein said fuel source is a return fuel line.

6. A fuel delivery system for delivering fuel from a fuel tank to a fuel metering system of an internal combustion engine, the system comprising:

(1) a fuel pump having a pump inlet and a pump outlet in fluid communication with the fuel metering system;

(2) a fuel reservoir in fluid communication with a fuel return line and a having reservoir outlet;

(3) a chamber connecting the pump inlet and the reservoir outlet;

(4) a flapper valve for permitting fuel flow from the tank to the chamber but preventing fuel flow from the chamber to the tank;

(5) a reservoir supply valve between the reservoir outlet and the chamber for regulating fuel flow from the reservoir to the chamber in response to fuel level within the fuel tank, the reservoir supply valve having an open position in which fuel flows from the reservoir to the chamber in a closed position in which fuel is preventing from flowing from the reservoir to the chamber; and (6) a fuel level sender for controlling movement of the reservoir supply valve between the open position and the closed position.

7. A fuel delivery system according to claim 6 wherein the fuel level sender actuates the reservoir supply valve to the open position when fuel in the fuel tank is below a predetermined level.

8. A fuel delivery system according to claim 7 wherein the fuel pump is mounted in the fuel reservoir.

9. A fuel delivery system according to claim 6 wherein the reservoir is an enclosed so as to be pressurizable by fuel entering therein from the return line.

10. A fuel delivery system according to claim 9 wherein the reservoir has a relief valve which opens when pressure within the reservoir exceeds a predetermined pressure to allow fuel flow from the reservoir to the tank.

11. An automotive fuel delivery system for delivering fuel from a fuel tank to a fuel metering system of an internal combustion engine, the system comprising:

(1) a fuel pump having a pump inlet and a pump outlet in fluid communication with the fuel metering system;

(2) a fuel reservoir in fluid communication with a fuel return line and having a reservoir outlet;

(3) a chamber connecting the pump inlet and the reservoir outlet;

(4) a flapper valve for permitting fuel flow from the tank to the chamber but preventing fuel flow from the chamber to the tank;

(5) a reservoir supply valve between the reservoir outlet and the chamber having an open position in which fuel flows from the reservoir to the chamber and a closed position in which fuel is prevented from flowing from the reservoir to the chamber; and (6) a fuel level sender operatively associated with the reservoir supply valve to move the reservoir supply valve to the open position when fuel within the fuel tank is below a predetermined level so that fuel from the reservoir flows into the chamber to the pump inlet, the fuel level sender operable to move the reservoir supply valve to the closed position when fuel within the fuel tank is above the predetermined level so that fuel is prevented from flowing from the reservoir to the chamber.

12. A fuel delivery system according to claim 11 wherein the fuel level sender has a float arm with a first end attached to the reservoir for pivotable movement with respect thereto and a second end having a float attached thereto which rises and falls with changes in fuel level within the fuel tank thus rotating the float arm about the first end to contact supply valve actuation means for moving the reservoir supply valve between the open and closed positions.

13. A fuel delivery system according to claim 12 wherein the supply valve actuation means comprises a plunger extending from the reservoir supply valve which is depressed by the float arm when the fuel level of fuel within the fuel tank falls below the predetermined level, the plunger overcoming the force of a spring biasing the reservoir supply valve to the closed position to move the reservoir supply valve to the open position to allow fuel flow from the reservoir to the chamber, the float arm not depressing the plunger when fuel within the fuel tank is above the predetermined level so that the spring biases the reservoir supply valve to the closed position to prevent fuel flow from the reservoir to the chamber.

14. A fuel delivery system according to claim 11 wherein the fuel pump is mounted in the fuel reservoir.

* * * * *